US012504212B2

(12) United States Patent
Lee et al.

(10) Patent No.: US 12,504,212 B2
(45) Date of Patent: Dec. 23, 2025

(54) ICE MAKER

(71) Applicant: COWAY CO., LTD., Gongju-si (KR)

(72) Inventors: Gyoung Min Lee, Seoul (KR); Gyeong Jong Kim, Seoul (KR); Yong Yeon Noh, Seoul (KR); Jung Chul Park, Seoul (KR); Min Chul Yong, Seoul (KR); Ki Hong Min, Seoul (KR); Min Suk Chang, Seoul (KR); Woong Jung, Seoul (KR); Byung Hyo Ye, Seoul (KR); Chung Lae Kim, Seoul (KR); Do Han Kim, Seoul (KR); Dae Hwan Kim, Seoul (KR); Woo Jin Joo, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 132 days.

(21) Appl. No.: 18/559,474

(22) PCT Filed: May 10, 2021

(86) PCT No.: PCT/KR2021/005824
§ 371 (c)(1),
(2) Date: Nov. 7, 2023

(87) PCT Pub. No.: WO2022/239880
PCT Pub. Date: Nov. 17, 2022

(65) Prior Publication Data
US 2024/0230201 A1 Jul. 11, 2024

(51) Int. Cl.
*F25C 5/08* (2006.01)
*F25C 1/08* (2006.01)

(52) U.S. Cl.
CPC ..... *F25C 5/08* (2013.01); *F25C 1/08* (2013.01); *F25C 2500/08* (2013.01)

(58) Field of Classification Search
CPC ..... F25C 5/08; F25C 1/08; F25C 2500/08
See application file for complete search history.

(56) References Cited

U.S. PATENT DOCUMENTS

2010/0152895 A1 6/2010 Dai

FOREIGN PATENT DOCUMENTS

CN 112703356 A 4/2021
JP 2016-508592 A 3/2016
(Continued)

OTHER PUBLICATIONS

Machine Translation KR1020170047082 (Year: 2017).*
(Continued)

*Primary Examiner* — Joseph F Trpisovsky
(74) *Attorney, Agent, or Firm* — Oblon, McClelland, Maier & Neustadt, L.L.P.

(57) ABSTRACT

An ice maker includes: a refrigerant pipe having formed therein a pipe flow path for a refrigerant to flow through; a finger protruding from the refrigerant pipe and having formed therein a finger space that communicates with the pipe flow path for the refrigerant to flow through; a heater including a heating part provided in the refrigerant pipe to heat the finger, and an extension part extending from one end of the heating part to the outside of the refrigerant pipe; a heater holder that surrounds at least a portion of the extension part; and a sealing element for preventing the introduction of moisture through a gap between the outer peripheral surface of the extension part and the inner peripheral surface of the heater holder.

11 Claims, 8 Drawing Sheets

(56) References Cited

FOREIGN PATENT DOCUMENTS

| | | | | | |
|---|---|---|---|---|---|
| KR | 10-0163153 | B1 | | 1/1999 | |
| KR | 10-2003-0041685 | A | | 5/2003 | |
| KR | 10-0561543 | B1 | | 3/2006 | |
| KR | 10-2014-0132269 | A | | 11/2014 | |
| KR | 20170047082 | A | * | 10/2015 | ..... F25C 1/24 |
| KR | 10-2018-0128698 | A | | 12/2018 | |
| WO | WO-2009/025448 | A1 | | 2/2009 | |

OTHER PUBLICATIONS

Machine Translation CN112703356 (Year: 2021).*
Extended European Search Report issued Jan. 28, 2025 in European Patent Application No. 21942028.8, 7 pages.
International Search Report issued Feb. 4, 2022 in PCT/KR2021/005824, filed on May 10, 2021, 5 pages (with English Translation).

* cited by examiner

ICE MAKER

TECHNICAL FIELD

The present disclosure relates to an ice maker.

BACKGROUND ART

In general, an ice maker is used to make ice. A refrigerant may flow inside the ice maker, and the refrigerant having a temperature below the freezing point of water circulates inside the ice maker to lower a surface temperature of the ice maker to below the freezing point of water. For example, when the refrigerant circulates inside the ice maker while a portion of the ice maker is submerged in water in an ice tray, the water in the ice maker becomes ice. In this case, the ice produced by the ice maker may be separated from the ice maker and separately stored in an ice bucket or the like.

Meanwhile, when ice is produced while a portion of the ice maker is submerged in water, it is difficult to separate the ice maker from the ice. Conventionally, in order to easily separate the ice attached to the ice maker, the ice is separated from the ice maker through a heater capable of heating the ice maker. When the heater heats the ice maker, the portion of the ice maker in contact with the ice is heated to a predetermined temperature. In addition, the ice in contact with the heated ice maker melts, and the ice maker can be easily separated from the ice.

Korean Patent Application Publication No. 10-2018-0010815 discloses a heater attached to an upper portion of a refrigerant pipe. Such a structure has a problem in that electric power required for ice removal increases since the heater and a finger are spaced apart.

Korean Patent Application Publication Nos. 10-2013-0104467, 10-2014-0006488, 10-2019-0026405, and 10-2020-0031455 disclose a heater inserted inside a refrigerant pipe. Such a structure has an effect of reducing power required for ice removal because the heater and the finger are close together.

However, a fuse is provided inside the heater to prevent overheating of the heater. However, when the heater is subjected to a manufacturing process with a high processing temperature, such as welding, there is a risk of damage to the fuse inside the heater, which makes it difficult to directly couple the refrigerant pipe and the heater through welding. Accordingly, the heater and the refrigerant pipe are coupled in such a way that a heater holder for supporting the heater is coupled to the refrigerant pipe and the heater is supported by the heater holder. However, in this case, a phenomenon in which moisture penetrates into a gap between the heater holder and the heater occurs. The moisture does not directly affect the performance of the ice maker in the beginning, but may corrode the refrigerant pipe and the heater when used for a long time for several years. In addition, the moisture between the heater holder and the heater freezes and expands due to the refrigerant, and as a result, the ice maker may freeze and burst.

Accordingly, there is a need for an ice maker capable of preventing penetration of moisture between the refrigerant pipe and the heater and preventing freezing and bursting of the ice maker even when used for a long period of time.

DETAILED DESCRIPTION OF INVENTION

Technical Problems

In view of the above, embodiments of the present disclosure provides an ice maker capable of preventing penetration of moisture between a refrigerant pipe and a heater.

Further, embodiments of the present disclosure provides an ice maker capable of preventing freezing even when used for a long period of time.

Technical Solution

In accordance with one aspect of the present disclosure, there is provided an ice maker comprising: a refrigerant pipe having a pipe passage formed therein for a refrigerant to flow; a finger protruding from the refrigerant pipe and having a finger space communicating with the pipe passage for the refrigerant to flow; a beater including a heating part provided in the refrigerant pipe to heat the finger, and an extension part extending from one end of the heating part to an outside of the refrigerant pipe; a heater holder surrounding at least a portion of the extension part; and a sealing element that prevents moisture from entering through a gap between an outer peripheral surface of the extension part and an inner peripheral surface of the heater holder.

Further, the ice maker may further comprise a partition wall that partitions the pipe passage and the finger space, wherein the heater holder may include: an inner holder part further surrounding an outer peripheral surface of the heating part and extending in one direction within the refrigerant pipe; and an outer holder part surrounding at least a portion of the outer peripheral surface of the extension part, and wherein the partition wall surrounds at least a portion of the inner holder part to securely support the heater holder, and extends along a direction in which the finger protrudes from the inner holder part.

Further, in the ice maker, the gap may range from 0.002 mm to 0.02 mm.

Further, in the ice maker, the sealing element may have elasticity and may be joined to an end of the heater holder and the outer peripheral surface of the extension part.

Further, in the ice maker, the sealing element may include silicone.

Further, in the ice maker, the heater holder may include: an inner holder part further surrounding an outer peripheral surface of the heating part; and an outer holder part surrounding at least a portion of the outer peripheral surface of the extension part, wherein at least a portion of the outer holder part may be provided with an expansion region having a larger diameter than the inner holder part, and the sealing element may seal between an inner peripheral surface of the expansion region and the extension part.

Further, in the ice maker, a seating groove for seating the sealing element may be formed on the outer peripheral surface of the extension part.

Further, in the ice maker, the heater holder may include: an inner holder part further surrounding an outer peripheral surface of the heating part; and an outer holder part surrounding at least a portion of the outer peripheral surface of the extension part, wherein the sealing element may be a tube having elasticity, and may surround the outer holder part while being in close contact with the outer holder part on one side, and surround the extension part while being in close contact with the extension part on the other side.

Further, the ice maker may further comprise: a first clamp surrounding and compressing the one side of the sealing element; and a second clamp surrounding and compressing the other side of the sealing element.

Further, in the ice maker, the heater holder may include: an inner holder part further surrounding an outer peripheral surface of the heating part; and an outer holder part surrounding at least a portion of the outer peripheral surface of the extension part, wherein the sealing element may include:

a ring housing surrounding the outer holder part and the extension part; a holder elastic ring supported on an inner peripheral surface of the ring housing and sealing between the ring housing and the outer holder part; and a heater elastic ring supported on the inner peripheral surface of the ring housing and sealing between the ring housing and the extension part.

Further, in the ice maker, the holder elastic ring may have a larger diameter than the heater elastic ring.

Further, in the ice maker, the sealing element may include a welded portion joined to an end of the heater holder and the outer peripheral surface of the extension part.

Effect of Invention

According to the embodiments of the present disclosure, it is possible to prevent penetration of moisture between the refrigerant pipe and the heater.

Further, it is possible to prevent freezing and bursting of the ice maker even when the ice maker is used for a long period of time.

BEST MODE FOR CARRYING OUT THE INVENTION

Hereinafter, specific embodiments for implementing the idea of the present disclosure will be described in detail with reference to the drawings.

Further, in describing the present disclosure, when it is determined that a detailed description of a related known configuration or function may obscure the gist of the present disclosure, the detailed description will be omitted.

In addition, when a component is referred to as 'supported', 'introduced', 'supplied', or 'flowed' with respect to the other component, it my be supported, introduced, supplied, or may flow directly to the other component, but it should be understood that other components may exist therebetween.

The terms used in the present specification are only used to describe specific embodiments and are not intended to limit the present disclosure. Singular expressions include plural expressions unless the context clearly indicates otherwise.

The terms including ordinal numbers, such as first, second, etc., may be used for describing various components, but the corresponding components are not limited by these terms. These terms are only used for the purpose of distinguishing one component from another component.

The meaning of "including" used in the present specification specifies specific features, regions, integers, steps, operations, elements, and/or components, does not exclude the presence or addition of other specific features, regions, integers, steps, operations, elements, components, and/or groups.

Hereinafter, the specific configuration of an ice maker 1 according to one embodiment of the present disclosure will be described with reference to the drawings.

Figure 1:
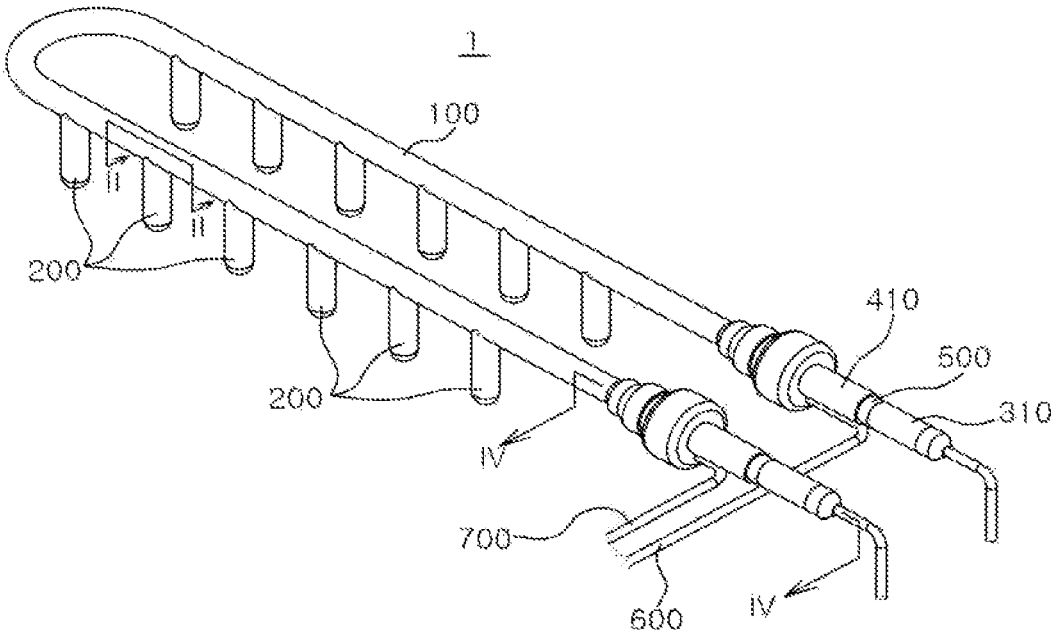
FIG. 1 is a perspective view showing an ice maker according to one embodiment of the present disclosure.

Referring to FIG. 1, the ice maker 1 according to one embodiment of the present disclosure can be used to produce ice. Further, the ice maker 1 can use refrigerant at a predetermined temperature or lower to produce ice. The ice maker 1 may include a refrigerant pipe 100, a finger 200, a partition wall 220, a heater 300, a heater holder 400, a sealing element 500, a refrigerant supply tube 600, and a refrigerant discharge tube 700.

Figure 2:
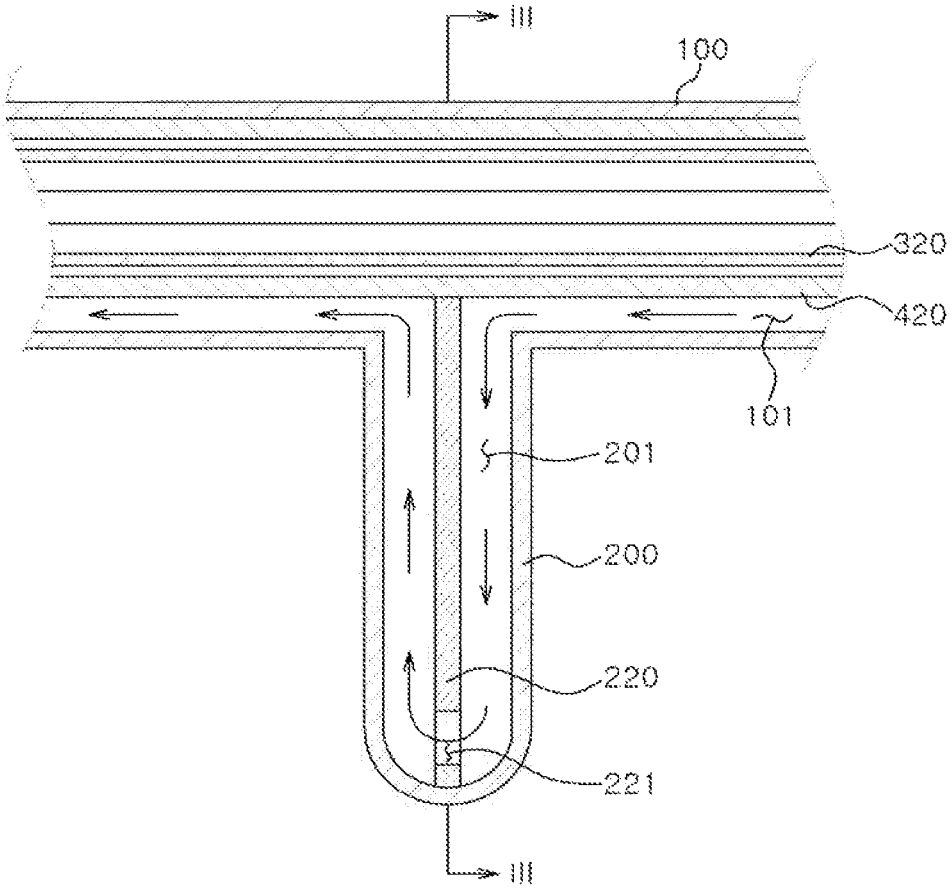
FIG. 2 is a cross-sectional view of the ice maker taken along line II-II of FIG. 1.

Referring further to FIG. 2, the refrigerant pipe 100 extends in one direction and may provide a space for the refrigerant to flow. Further, the refrigerant pipe 100 may accommodate a portion of the heater 300 and the heater holder 400. The refrigerant pipe 100 may extend along a path, and for example, the path may be formed to have a 'U' shape when viewed from above. In addition, a pipe passage 101 through which the refrigerant flows may be formed inside the refrigerant pipe 100. The refrigerant flowing into one end of the pipe passage 101 flows along the pipe passage 101 and may be discharged through the other end of the pipe passage 101. Further, the refrigerant flowing along the pipe passage 101 may have a temperature lower than the freezing point of water.

The finger 200 may contact water contained in an ice tray (not shown) at its outer surface to cool the water in the ice tray. The finger 200 may protrude from the refrigerant pipe 100 and may be provided in plurality. For example, a direction in which a plurality of fingers 200 protrude from the refrigerant pipe 100 may be perpendicular to the direction in which the refrigerant pipe 100 extends, and the protrusion direction may be downward. Further, a finger space 201 communicating with the pipe passage 101 may be formed in the finger 200 for the refrigerant to flow.

Figure 3:
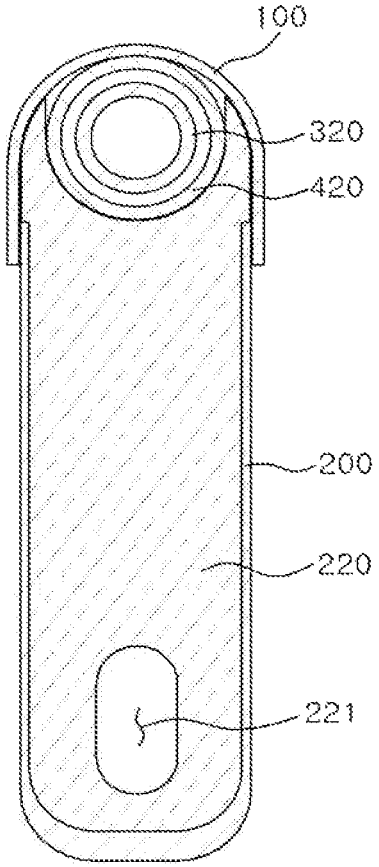
FIG. 3 is a cross-sectional view of the ice maker taken along line III-III of FIG. 2.

Referring further to FIG. 3, the partition wall 220 may surround at least a portion of an outer peripheral surface of an inner holder part 420 to securely support the heater holder 400. Further, the partition wall 220 may be provided in plurality, and a plurality of partition walls 220 may be respectively provided in the plurality of finger spaces 201 to partition the finger spaces 201. The partition wall 220 extends in a direction that is different from the direction in which the inner holder part 420 extends to partition the pipe passage 101 and the finger space 201. For example, the partition wall 220 may partition the pipe passage 101 and the finger space 201 in a direction perpendicular to the direction in which the inner holder part 420 extends. As another example, the partition wall 220 may partition the finger space 201 into a space (first finger passage), communicating with the pipe passage 101, for the refrigerant to flow to an end of the finger space 201 and a space (second finger passage), communicating with the pipe passage 101, for the refrigerant to flow from the end of the finger space 201 toward the pipe passage 101. The partition wall 220 may protrude from the inner holder part 420 to be described later, and may extend along the direction in which the finger 200 protrudes. Further, a flow hole 221 may be formed in the partition wall 220 for the refrigerant to pass through.

The flow hole 221 may be formed through the partition wall 220 and may allow the first finger passage and the second finger passage of the partition wall 220 to communicate with each other. For example, the refrigerant flowing into the first finger passage from the pipe passage 101 may flow into the second finger passage through the flow hole 221 and then flow into the pipe passage 101. One or more flow holes 221 may be formed in the partition wall 220. Although, in the present specification, the flow hole 221 is described as being formed in the partition wall 220, this is only an example, and one side of the partition wall 220 is spaced apart from the finger 200, so the flow hole 221 may include a separation space between the partition wall 220 and the fingers 200.

The heater 300 may directly or indirectly heat one or more of the finger 200 and the heater holder 400. For example, the heater 300 may be driven to heat the heater holder 400, and the finger 200 may be heated by heating the heater holder 400. As such, as the finger 200 is heated by the heater 300, the ice formed on the outer surface of the finger 200 may slightly melt and separate from the finger 200. The heater 300 may include an extension part 310 and a heating part 320.

The extension part 310 may extend from one end of the heating part 320 to the outside of the refrigerant pipe 100. Further, at least a portion of the extension part 310 may be inserted into the outer holder part 410 and may be formed to extend along the extension direction of the outer holder part 410. Although the extension part 310 is described as a member extending along the heating part 320, this is only an example, and the extension part 310 may heat the outer holder part 410 like the heating part 320.

The heating part 320 may be provided in the refrigerant pipe 100 to melt ice attached to the finger 200. The heat generated by the heating part 320 may be sequentially transferred to the inner holder part 420, the partition wall 220, and the finger 200. Further, the heating part 320 may be inserted into the inner holder part 420 to extend along the inner holder part 420.

Figure 4:
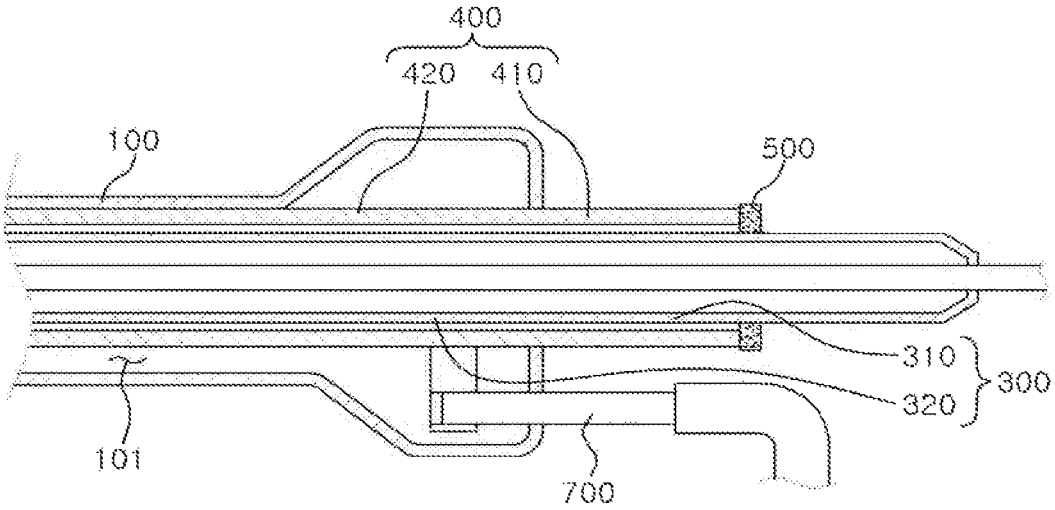
FIG. 4 is a cross-sectional view of an ice maker according to a first embodiment of the present disclosure taken along line IV-IV in FIG. 1.

Referring to FIG. 4, the heater holder 400 may be provided to surround the heater 300. The heater 300 may be placed inside the heater holder 400, and a gap may be formed between an outer peripheral surface of the heater 300 and an inner peripheral surface of the heater holder 400. For example, the gap between the outer peripheral surface of the heater 300 and the inner peripheral surface of the heater holder 400 may range from 0.002 mm to 0.02 mm. The heater holder 400 may include the outer holder part 410 provided to surround an outer peripheral surface of the extension part 310 and the inner holder part 420 provided to surround an outer peripheral surface of the heating part 320.

The sealing element 500 can prevent moisture from flowing between the outer peripheral surface of the heater 300 and the inner peripheral surface of the heater holder 400. In other words, the sealing element 500 may be provided to block the gap between the outer peripheral surface of the extension part 310 and the inner peripheral surface of the outer holder part 410 from the outside. The sealing element 500 may be joined to an end of the outer holder part 410 and the outer peripheral surface of the extension part 310. Further, the sealing element 500 may include an elastic member, for example, silicone.

The refrigerant supply tube 600 may supply refrigerant to the refrigerant pipe 100. The refrigerant supply tube 600 may be connected to one end of the refrigerant pipe 100 to communicate with the pipe passage 101.

The refrigerant discharge tube 700 may discharge the refrigerant flowing into the refrigerant pipe 100 from the refrigerant pipe 100 to the outside. The refrigerant discharge tube 700 may be connected to the other end of the refrigerant pipe 100 to communicate with the pipe passage 101.

Hereinafter, the operation and effects of the ice maker 1 having the above-described configurations will be described.

The ice maker 1 can be supplied with refrigerant to make ice. The refrigerant pipe 100 of the ice maker 1 may receive refrigerant from the refrigerant supply tube 600. The refrigerant flowing into the refrigerant pipe 100 may flow along the pipe passage 101. Further, the refrigerant may flow in the finger space 201 of the finger 200 immersed in water and lower the temperature of the finger 200 below the freezing point of water. In this case, the water in the ice tray is solidified into ice by the finger 200.

Further, the heater 300 can heat the finger 200 to a predetermined temperature range by heating the heater holder 400. In this case, the ice in contact with the finger 200 melts, and the finger 200 can be easily separated from the ice.

Meanwhile, in the ice maker 1 according to one embodiment of the present disclosure, the sealing element 500 blocks the gap between the heater 300 and the heater holder 400 from the outside, thereby preventing moisture from penetrating the gap between the heater 300 and the heater holder 400.

In addition, through the sealing element 500, it is possible to prevent the ice maker 1 from freezing and bursting due to moisture penetrating between the heater 300 and the heater holder 400.

In addition, through the sealing element 500, it is possible to prevent corrosion of the heater 300 or the heater holder 400 due to moisture penetrating between the heater 300 and the heater holder 400.

Meanwhile, in addition to such configurations, according to a second embodiment of the present disclosure, an expansion region 411 may be provided. Hereinafter, the second embodiment of the present disclosure will be described with further reference to FIG. 5. In describing the second embodiment, the differences compared to the above-described embodiment will be mainly described, and the same description and reference numerals will be referred to the above-described embodiment.

Figure 5:
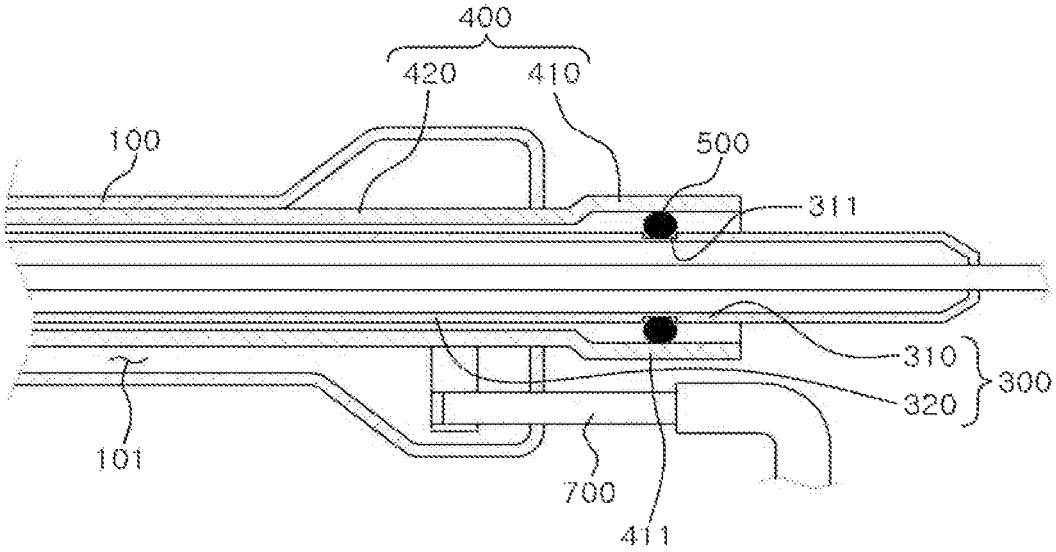
FIG. 5 is a cross-sectional view of an ice maker according to a second embodiment of the present disclosure taken along line IV-IV in FIG. 1.

Referring to FIG. 5, at least a portion of the outer holder part 410 may be provided with an expansion region 411 having a larger diameter than the inner holder part 420. The expansion region 411 may surround at least a portion of the extension part 310. Further, a gap between the expansion region 411 and the extension part 310 may be larger than the gap between the inner holder part 420 and the heating part 320.

A seating groove 311 for seating the sealing element 500 may be formed on the outer peripheral surface of the extension part 310. The seating groove 311 may be formed to be recessed from the outer peripheral surface of the extension part 310 to a predetermined depth. Further, the seating groove 311 may be formed on a portion of the outer peripheral surface of the extension part 310 which corresponds to the expansion region 411.

The sealing element 500 can seal between an inner peripheral surface of the expansion region 411 and the outer peripheral surface of the extension part 310. In this case, the sealing element 500 can more effectively seal between the inner peripheral surface of the expansion region 411 and the outer peripheral surface of the extension part 310 by being inserted into the seating groove 311 of the extension part 310.

Meanwhile, in addition to such configurations, according to a third embodiment of the present disclosure, a sealing elastic ring 510 and a clamp 520 may be further included. Hereinafter, the third embodiment of the present disclosure will be described with further reference to FIG. 6. In describing the third embodiment, the differences compared to the above-described embodiments will be mainly explained, and the same description and reference numerals will be referred to the above-described embodiments.

Figure 6:
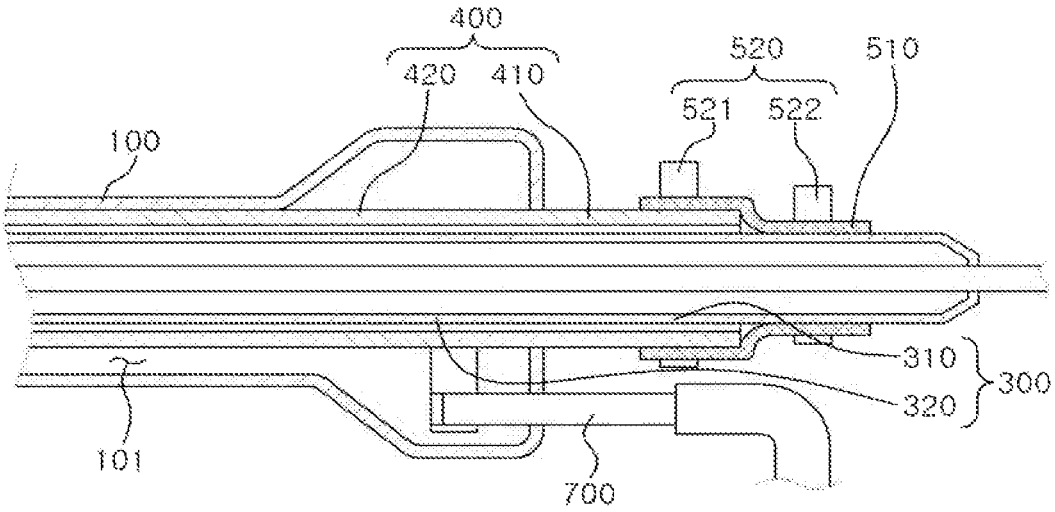
FIG. 6 is a cross-sectional view of an ice maker according to a (bird embodiment of the present disclosure taken along line IV-IV in FIG. 1.

Referring to FIG. 6, the sealing element 500 may further include a sealing elastic ring 510 and a clamp 520.

The sealing elastic ring 510 can block the gap between the extension part 310 and the outer holder part 410 from the outside. One side of this sealing elastic ring 510 may surround the outer holder part 410 while being in close contact with the outer holder part 410, and the other side of the sealing elastic ring 510 may surround the extension part 310 while being in close contact with the extension part 310. Accordingly, the gap between the extension part 310 and the outer holder part 410 can be blocked from the outside by the sealing elastic ring 510. For example, the sealing element 500 may be provided in the form of an elastic tube.

The clamp 520 can bring the sealing elastic ring 510 into close contact with the extension part 310 and the outer holder part 410. The clamp 520 may include a first clamp 521 that surrounds one side of the sealing elastic ring 510 to press it against the outer holder part 410, and a second clamp 522 that surrounds the other side of the sealing elastic ring 510 to press it against the extension part 310.

Meanwhile, in addition to such configurations, according to a fourth embodiment of the present disclosure, the sealing element 500 may include a ring housing 540 and a fitting elastic ring 550. Hereinafter, the fourth embodiment of the present disclosure will be described with further reference to FIG. 7. In describing the fourth embodiment, the differences compared to the above-described embodiments will be mainly explained, and the same description and reference numerals will be referred to the above-described embodiments.

Figure 7:
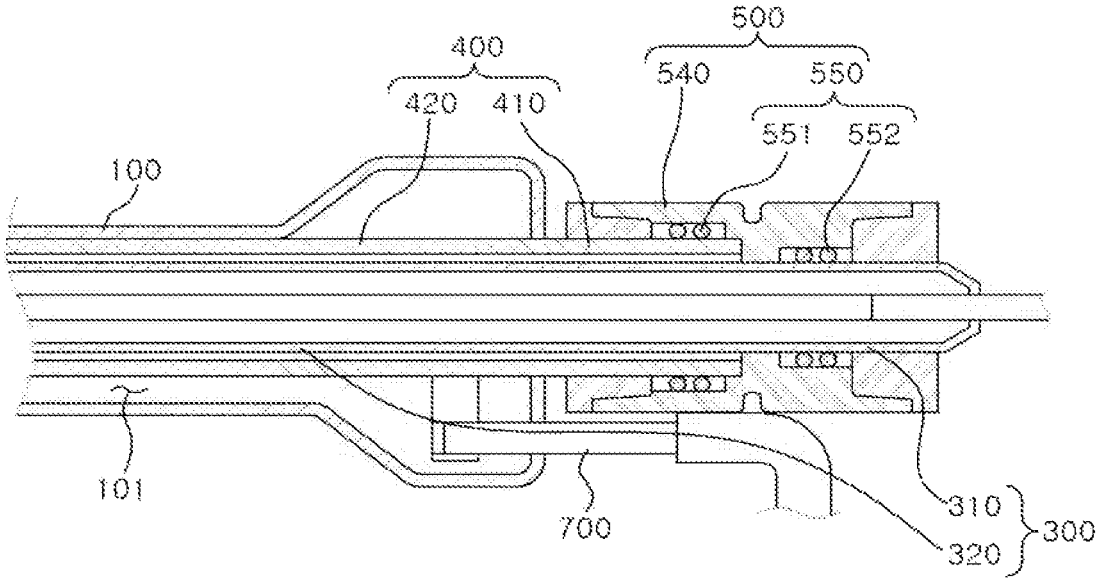
FIG. 7 is a cross-sectional view of an ice maker according to a fourth embodiment of the present disclosure taken along line IV-IV in FIG. 1.

Referring to FIG. 7, the sealing element 500 may include a ring housing 540 and a fitting elastic ring 550.

The ring housing 540 may be fastened to the extension part 310 and the outer holder part 410 to surround the extension part 310 and the outer holder part 410. Further, an end portion of the outer holder part 410 may be accommodated within the ring housing 540. The ring housing 540 can block the gap between the extension part 310 and the outer holder part 410 from the outside. For example, a portion of the ring housing 540 can block the gap between the extension part 310 and the outer holder part 410 from the outside of the ring housing 540 while being in close contact with one end portion of the outer holder part 410 and the outer peripheral surface of the extension part 310. A holder elastic ring 551 may be interposed between an inner peripheral surface of the ring housing 540 and the outer peripheral surface of the outer holder part 410, and a heater elastic ring 552 may be interposed between the inner peripheral surface of the ring housing 540 and the outer peripheral surface of the extension part 310.

The fitting elastic ring 550 can seal one or more of the gap between the ring housing 540 and the outer holder part 410 and the gap between the ring housing 540 and the extension part 310. The fitting elastic ring 550 may include the holder elastic ring 551 and the heater elastic ring 552.

The holder elastic ring 551 is supported on the inner peripheral surface of the ring housing 540 and can seal between the ring housing 540 and the outer holder part 410. The heater elastic ring 552 is supported on the inner peripheral surface of the ring housing 540 and can seal between the ring housing 540 and the extension part 310. For example, the holder elastic ring 551 and the heater elastic ring 552 may be rubber rings.

Meanwhile, in addition to such configurations, according to a fifth embodiment of the present disclosure, the sealing element 500 may further include a welded portion. Hereinafter, the fifth embodiment of the present disclosure will be described with further reference to FIG. 8. In describing the fifth embodiment, the differences compared to the above-described embodiments will be mainly explained, and the same description and reference numerals will be referred to the above-described embodiments.

Figure 8:
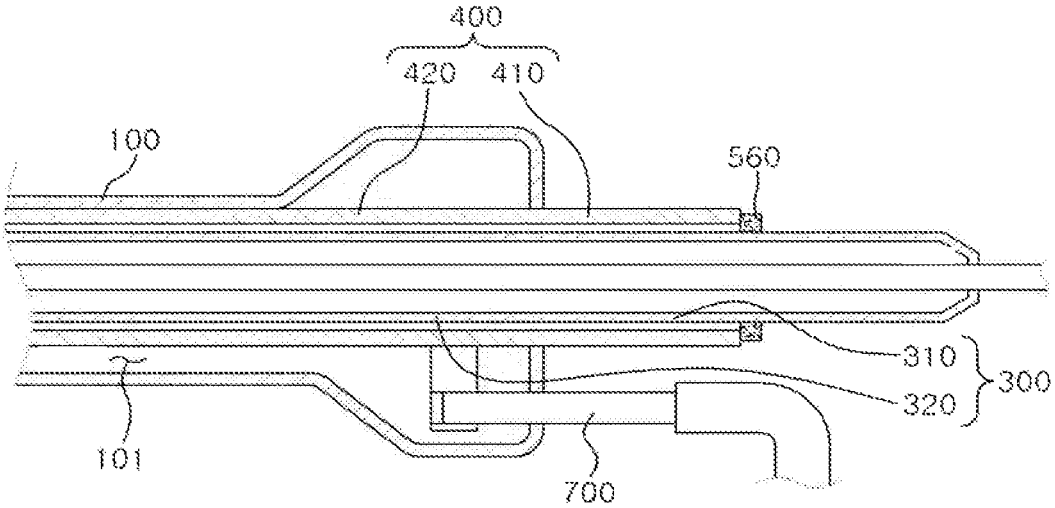
FIG. 8 is a cross-sectional view of an ice maker according to a fifth embodiment of the present disclosure taken along line IV-IV in FIG. 1.

Referring to FIG. 8, the sealing element may include a welded portion 560 joined to one end of the heater holder 400 and the outer peripheral surface of the extension part 310. The welded portion can block the gap between one end of the outer holder part 410 and the extension part 310 from the outside. For example, the welded portion may be formed through welding between one end of the outer holder part 410 and the extension part 310.

Although the embodiments of the present disclosure have been described as specific embodiments, these are merely examples. The present disclosure is not limited to the above, and should be interpreted as having the broadest scope according to the technical idea disclosed in the present specification. Those skilled in the art may combine/substitute the disclosed embodiments to implement a pattern of a shape not disclosed herein, but his also does not depart from the scope of the present disclosure. In addition, those skilled in the art may easily change or modify the disclosed embodiments based on the present specification, and it is clear that such changes or modifications also fall within the scope of the present disclosure.

What is claimed is:

1. An ice maker comprising:

a refrigerant pipe having a pipe passage formed therein for a refrigerant to flow;

a finger protruding from the refrigerant pipe and having a finger space communicating with the pipe passage for the refrigerant to flow;

a heater including a heating part provided in the refrigerant pipe to heat the finger, and an extension part extending from one end of the heating part to an outside of the refrigerant pipe;

a heater holder surrounding at least a portion of the extension part; and a sealing element that prevents moisture from entering through a gap between an outer peripheral surface of the extension part and an inner peripheral surface of the heater holder, wherein the heater holder includes:

an inner holder part further surrounding an outer peripheral surface of the heating part; and an outer holder part surrounding at least a portion of the outer peripheral surface of the extension part, wherein at least a portion of the outer holder part is provided with an expansion region having a larger diameter than the inner holder part, and wherein the sealing element seals between an inner peripheral surface of the expansion region and the extension part.

2. The ice maker of claim 1, further comprising a partition wall that partitions the pipe passage and the finger space, wherein the partition wall surrounds at least a portion of the inner holder part to securely support the heater holder, and extends along a direction in which the finger protrudes from the inner holder part.

3. The ice maker of claim 1, wherein the gap ranges from 0.002 mm to 0.02 mm.

4. The ice maker of claim 1, wherein the sealing element has elasticity and is joined to an end of the heater holder and the outer peripheral surface of the extension part.

5. The ice maker of claim 4, wherein the sealing element includes silicone.

6. The ice maker of claim 1, wherein a seating groove for seating the sealing element is formed on the outer peripheral surface of the extension part.

7. An ice maker comprising:

a refrigerant pipe having a pipe passage formed therein for a refrigerant to flow;

a finger protruding from the refrigerant pipe and having a finger space communicating with the pipe passage for the refrigerant to flow;

a heater including a heating part provided in the refrigerant pipe to heat the finger, and an extension part extending from one end of the heating part to an outside of the refrigerant pipe;

a heater holder surrounding at least a portion of the extension part; and a sealing element that prevents moisture from entering through a gap between an outer peripheral surface of the extension part and an inner peripheral surface of the heater holder, wherein the heater holder includes:

an inner holder part further surrounding an outer peripheral surface of the heating part; and an outer holder part surrounding at least a portion of the outer peripheral surface of the extension part, and wherein the sealing element is a tube having elasticity, and surrounds the outer holder part while being in close contact with the outer holder part on one side, and surrounds the extension part while being in close contact with the extension part on the other side.

8. The ice maker of claim 7, further comprising:

a first clamp surrounding and compressing the one side of the sealing element; and a second clamp surrounding and compressing the other side of the sealing element.

9. An ice maker comprising:

a refrigerant pipe having a pipe passage formed therein for a refrigerant to flow;

a finger protruding from the refrigerant pipe and having a finger space communicating with the pipe passage for the refrigerant to flow;

a heater including a heating part provided in the refrigerant pipe to heat the finger, and an extension part extending from one end of the heating part to an outside of the refrigerant pipe;

a heater holder surrounding at least a portion of the extension part; and a sealing element that prevents moisture from entering through a gap between an outer peripheral surface of the extension part and an inner peripheral surface of the heater holder, wherein the heater holder includes:

an inner holder part further surrounding an outer peripheral surface of the heating part; and an outer holder part surrounding at least a portion of the outer peripheral surface of the extension part, and wherein the sealing element includes:

a ring housing surrounding the outer holder part and the extension part;

a holder elastic ring supported on an inner peripheral surface of the ring housing and sealing between the ring housing and the outer holder part; and a heater elastic ring supported on the inner peripheral surface of the ring housing and sealing between the ring housing and the extension part.

10. The ice maker of claim 9, wherein the holder elastic ring has a larger diameter than the heater elastic ring.

11. The ice maker of claim 1, wherein the sealing element includes a welded portion joined to an end of the heater holder and the outer peripheral surface of the extension part.

* * * * *